US009010158B2

(12) United States Patent
Yoo et al.

(10) Patent No.: US 9,010,158 B2
(45) Date of Patent: Apr. 21, 2015

(54) FABRIC TREATMENT APPARATUS

(75) Inventors: Hea Kyung Yoo, Seoul (KR); Jong Seok Kim, Seoul (KR); Sung Min Kim, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 1090 days.

(21) Appl. No.: 12/461,658

(22) Filed: Aug. 19, 2009

(65) Prior Publication Data

US 2010/0043500 A1 Feb. 25, 2010

(30) Foreign Application Priority Data

Aug. 20, 2008 (KR) ..... 10-2008-0081477

(51) Int. Cl.
*D06F 37/00* (2006.01)
*D06F 58/10* (2006.01)
*D06F 73/02* (2006.01)

(52) U.S. Cl.
CPC ..... *D06F 58/10* (2013.01); *D06F 73/02* (2013.01)

(58) Field of Classification Search
CPC ..... D06F 58/10; D06F 73/02
USPC ..... 34/621; 68/3 R, 5 C, 5 R
See application file for complete search history.

(56) References Cited

U.S. PATENT DOCUMENTS

| | | | | | |
|---|---|---|---|---|---|
| 3,644,085 | A | * | 2/1972 | Beeley et al. | 8/150 |
| 3,696,523 | A | * | 10/1972 | Beeley et al. | 34/216 |
| 3,732,628 | A | * | 5/1973 | Blevens et al. | 34/389 |
| 3,739,496 | A | * | 6/1973 | Buckley et al. | 34/210 |
| 3,861,179 | A | | 1/1975 | Orchard | |
| 3,899,108 | A | * | 8/1975 | Frauendorf | 223/51 |
| 4,304,053 | A | * | 12/1981 | Kellerhals et al. | 34/621 |
| 4,625,432 | A | * | 12/1986 | Baltes | 34/621 |
| 2005/0115120 | A1 | | 6/2005 | Cevik | |
| 2008/0155757 | A1 | | 7/2008 | Kim et al. | |

FOREIGN PATENT DOCUMENTS

| | | |
|---|---|---|
| JP | 06-339598 | 12/1994 |
| JP | 09-313793 | 12/1997 |
| JP | 2002-000997 | 1/2002 |
| KR | 10-0809580 | 3/2008 |

* cited by examiner

*Primary Examiner* — Michael Kornakov
*Assistant Examiner* — Benjamin L Osterhout
(74) *Attorney, Agent, or Firm* — McKenna Long & Aldridge LLP

(57) ABSTRACT

A fabric treatment apparatus is provided. The fabric treatment apparatus includes a treatment room which can receive and hold clothes; a motor which generates a rotational force; an eccentric unit which is rotated eccentrically by the rotational force generated by the motor; a contact unit which converts the rotating motion of the eccentric unit into a reciprocating motion; a clothes rack which is disposed in the treatment room and is coupled to the contact unit so as to move reciprocally in a linear path, and on which a number of hangers can be hung; and a heating unit which supplies at least one of hot air and steam into the treatment room.

8 Claims, 5 Drawing Sheets

FABRIC TREATMENT APPARATUS

CROSS-REFERENCE TO RELATED APPLICATION

This application claims priority from Korean Patent Application No. 10-2008-0081477 filed on Aug. 20, 2008 in the Korean Intellectual Property Office, the disclosure of which is incorporated herein by reference in its entirety.

BACKGROUND OF THE INVENTION

1. Field of the Invention

The present invention relates to a fabric treatment machine, and more particularly, to a fabric treatment machine which can effectively treat clothes by properly moving the clothes.

2. Description of the Related Art

Fabric treatment apparatuses include various types of apparatuses for use in homes or in laundries or cleaners for managing or treating clothes such as washing, drying, or smoothing out the clothes such as a washing machine for washing clothes, a dryer for drying wet laundry, a washer dryer equipped with both a washing function and a dryer function, a refresher for refreshing clothes, and a steamer for smoothing out clothes.

In particular, the refresher is a device for refreshing clothes by drying the clothes, perfuming the clothes, preventing the clothes from getting static, or smoothing out the clothes. The steamer is a device for smoothing out clothes by supplying steam. The steamer, unlike an iron, does not involve applying a hot plate onto clothes and may thus be able to smooth out clothes more delicately than an iron.

A fabric treatment apparatus into which the functions of a refresher and a steamer are incorporated may smooth out or deodorize clothes held therein by using steam and hot air. By using this type of fabric treatment apparatus, it is possible to effectively deodorize clothes and offer the benefits of ironing out clothes.

SUMMARY OF THE INVENTION

The present invention provides a fabric treatment apparatus in which a clothes rack can be moved.

The present invention also provides a fabric treatment apparatus which can improve the efficiency of treatment of clothes by moving a clothes rack therein.

According to an aspect of the present invention, there is provided a fabric treatment apparatus including a treatment room which can receive and hold clothes; a motor which generates a rotational force; an eccentric unit which is rotated eccentrically by the rotational force generated by the motor; a contact unit which converts the rotating motion of the eccentric unit into a reciprocating motion; a clothes rack which is disposed in the treatment room and is coupled to the contact unit so as to move reciprocally in a linear path, and on which a number of hangers can be hung; and a heating unit which supplies at least one of hot air and steam into the treatment room.

BRIEF DESCRIPTION OF THE DRAWINGS

The above and other features and advantages of the present invention will become more apparent by describing in detail preferred embodiments thereof with reference to the attached drawings in which:

FIG. 6 illustrates an eccentric unit of the fabric treatment apparatus of the exemplary embodiment of.

DETAILED DESCRIPTION OF THE INVENTION

Figure 1:
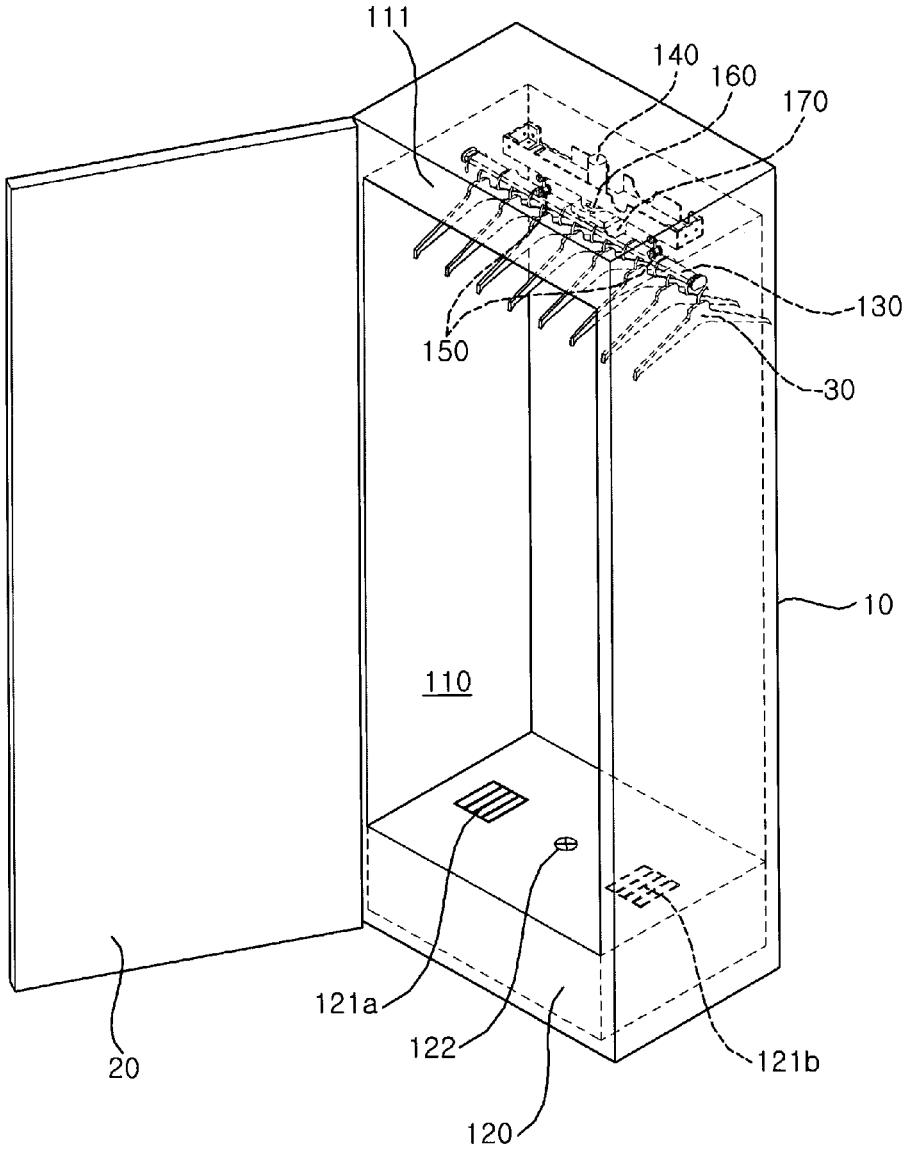
FIG. 1 illustrates a perspective view of a fabric treatment apparatus according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

Fabric treatment apparatuses according to exemplary embodiments of the present invention will hereinafter be described in detail with reference to FIGS. 1 through 6.

Figure 2:
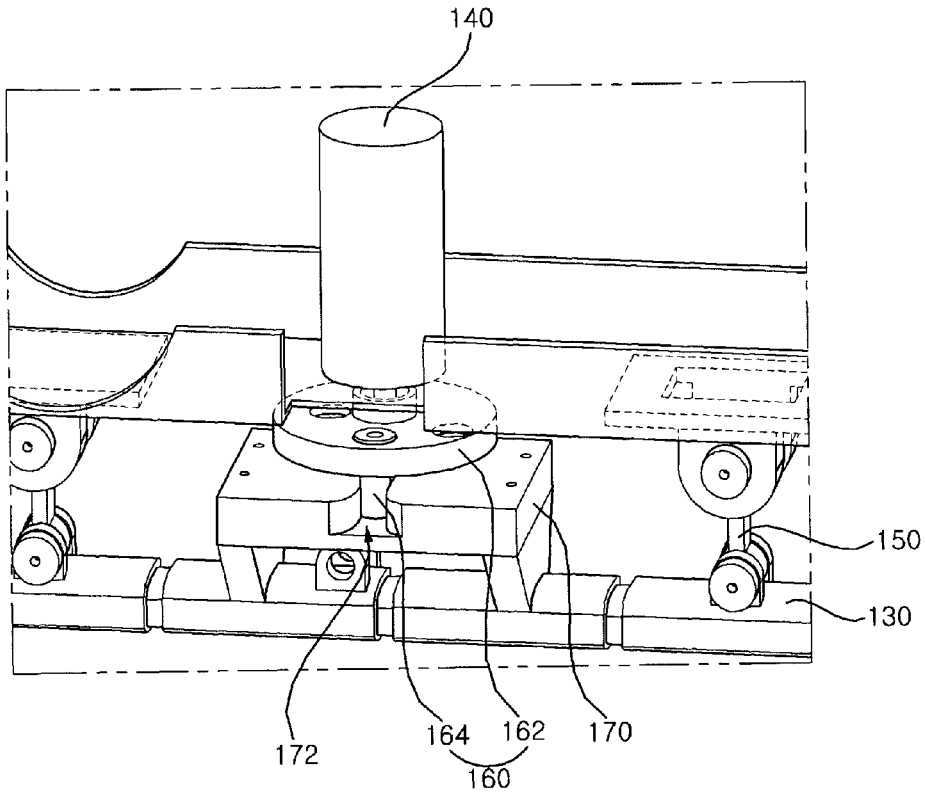
FIG. 2 illustrates a partial view of the fabric treatment apparatus shown in FIG. 1.

FIG. 1 illustrates a perspective view of a fabric treatment apparatus according to an exemplary embodiment of the present invention, and FIG. 2 illustrates a partial view of the fabric treatment apparatus shown in FIG. 1. Referring to FIGS. 1 and 2, the fabric treatment apparatus may include a treatment room 110 in which clothes are contained, a motor 140 which generates rotation force, an eccentric unit 160 which is rotated eccentrically by the rotation force generated by the motor 140, a contact unit 170 which is connected to the eccentric unit 160, a clothes rack 130 which is coupled to the contact unit 170 and moves reciprocally in a linear path, and a heating unit 120 which supplies at least one of hot air and steam into the treatment room 110.

The treatment room 110 may provide room for holding clothes. The treatment room 110 may be provided in a cabinet 10, which forms the exterior of the treatment room 110. A ceiling 111 of the treatment room 110 may be spaced from the ceiling of the cabinet 10, and the motor 140 may be disposed in the empty space between the cabinet 10 and the ceiling 111 of the treatment room 110.

One side of the treatment room 110 may be open, and the treatment room 110, and a door 20 may open or close the open side of the treatment room 110. When the door 20 is closed, the treatment room 110 may be isolated from the outside of the fabric treatment apparatus. When the door 20 is open, the treatment room 110 may be exposed. A user may open the door 20, may put clothes in the treatment room 110, may close the door 20 and may operate the fabric treatment apparatus.

An air outlet 121*a* through which air in the treatment room 110 can be ejected from the treatment room 110, a hot air inlet 121*b* through which hot air can be injected into the treatment room 110 and a steam injection hole 122 through which steam can be injected into the treatment room 110 may be provided in the treatment room 110. Connectors 150 may be provided at the ceiling 111 of the treatment room 110 and may be connected to the clothes rack 130.

The motor 140 may be partially exposed outside the treatment room 110. The main body of the motor 140 may be disposed between the ceiling of the treatment room 110 and the ceiling of the cabinet 10, and a rotation axial member of the motor 140 may penetrate the ceiling 111 of the treatment room 110. The rotation axial member of the motor 140 may be coupled to the eccentric unit 160 in the treatment room 110.

The eccentric unit 160 may be rotated eccentrically by the rotation force generated by the motor 140. The eccentric unit 160 may be coupled to the rotation axial member of the motor 140, and may be slidably coupled to the contact unit 170. The eccentric unit 160 may convert a rotating motion into a linear reciprocating motion in connection with the contact unit 170.

The eccentric unit 160 may include a circular plate 162 which is rotated by the rotation force generated by the motor 140 and an electric pin 164 which is located eccentrically with respect to the circular plate 162 and is slidably coupled to the contact unit 170. The rotation axial member of the motor 140 may be coupled to the center of the circular plate 162, and the eccentric pin 164 may be coupled onto the first quadrant of the circular plate 162. More specifically, the eccentric pin 164 may be coupled eccentrically to the circular plate 162. The eccentric pin 164 may be slidably coupled to a slot 172 of the contact unit 170.

The contact unit 170 may convert a rotating motion into a reciprocating motion in connection with the eccentric unit 160. The contact unit 170 may include the slot 172, which is formed as a narrow straight valley and is slidably coupled to the eccentric unit 160. The contact unit 170 may also include a guide which is formed as a bar-shaped protrusion. The slot 172 may be slidably coupled to the eccentric pin 164 of the eccentric unit 160.

The contact unit 170 may be coupled to the clothes rack 130, and may move the clothes rack 130 reciprocally in a linear path. The contact unit 170 may be formed in one body with the clothes rack 130. In this case, the slot 172 may be formed at the top of the clothes rack 130.

The eccentric unit 160 and the contact unit 170 may be implemented in various manners, other than those set forth herein, as long as they can convert a rotating motion into a reciprocating motion. For example, the eccentric unit 160 and contact unit 170 may be implemented as various mechanical elements such as cams, racks and pinions, and crank shafts and connecting rods. The eccentric unit 160 and the contact unit 170 may be formed in one body with each other.

The clothes rack 130 may include a plurality of hangers 30 on which clothes can be hung up. A plurality of grooves may be formed on the clothes rack 130 so that the hangers 30 can be properly hung up on the clothes rack 130. When the clothes rack 130 reciprocally moves in a linear path, the hangers 30 may also reciprocally move along with the clothes rack 130.

The clothes rack 130 may be coupled to the contact unit 170, which converts a rotating motion into a reciprocating motion, and may reciprocally move in a linear path. The clothes rack 130 may be fixed to the contact unit 170. Alternatively, the clothes rack 130 may be coupled flexibly to the contact unit 170.

The clothes rack 130 may be connected to the ceiling 111 of the treatment room 110 by the connectors 150. More specifically, the connectors 150 may be rotatably coupled to the ceiling 111 of the treatment room 110 and the clothes rack 130. The connectors 150 may be formed of an elastic material so as to help the clothes rack 130 reciprocally move in a linear path. In addition, the connectors 150 may be implemented as guard rails and may be slidably coupled to the ceiling 111 of the treatment room 110.

The heating unit 120 may be provided below the treatment room 110, and may supply hot air and/or steam into the treatment room 110. The heating unit 120 may be implemented in various manners by one of ordinary skill in the art to which the present invention pertains. For example, the heating unit 120 may be implemented as an electric heater or a heat pump.

The heating unit 120 may suck air from the treatment room 110, heat the air, and may supply the heated air into the treatment room 110. In addition, the heating unit 120 may be supplied with water, may generate steam by heating the water, and may inject the steam into the treatment room 110. The heating unit 120 may supply both hot air and steam into the treatment room 110 at the same time.

The heating unit 120 may include the air outlet 121*a* through which air in the treatment room 110 can be ejected from the treatment room 110, the hot air inlet 121*b* through which hot air can be injected into the treatment room 110 and the steam injection hole 122 through which steam can be injected into the treatment room 110.

Referring to FIGS. 1 and 2, the fabric treatment apparatus may also include the connectors 150 connecting the clothes rack 130 to the top of the treatment room 110. The connectors 150 may be rotatably coupled to the ceiling 111 of the treatment room 110. In addition, the connectors 150 may be rotatably coupled to the clothes rack 130.

The operation of the fabric treatment apparatus of the exemplary embodiment of FIGS. 1 and 2 will hereinafter be described in detail.

The user may open the door 20, may hang up the hangers 30 where clothes are hung up on the clothes rack 130, may shut the door 20, and may operate the fabric treatment apparatus.

Then, the heating unit 120 may supply hot air and/or steam into the treatment room 110 according to the type of operating mode of the fabric treatment apparatus. The heating unit 120 may heat air sucked out of the treatment room 110 via the air outlet 121*a*, and may inject the heated air into the treatment room 110 via the hot air inlet 121*b*. In addition, the heating unit 120 may spray steam into the treatment room 110 via the steam injection hole 122.

When the heating unit 120 supplies hot air and/or steam into the treatment room 110, the motor 140 may rotate the circular plate 162 by generating rotation force outside the treatment room 110. When the circular plate 162 rotates, the eccentric pin 164 may rotate eccentrically, and the contact unit 170, which is slidably coupled to the eccentric pin 164, may move reciprocally in a linear path. Then, the clothes rack 130, which is coupled to the contact unit 170, may move reciprocally in a longitudinal direction thereof.

Then, the hangers 30 on the clothes rack 130 may also move reciprocally in a linear path and may thus be able to move the clothes thereon. In this manner, it is possible to improve the efficiency of treatment of the clothes on the hangers 30 with the hot air and/or the steam supplied by the heating unit 120.

Figure 3:
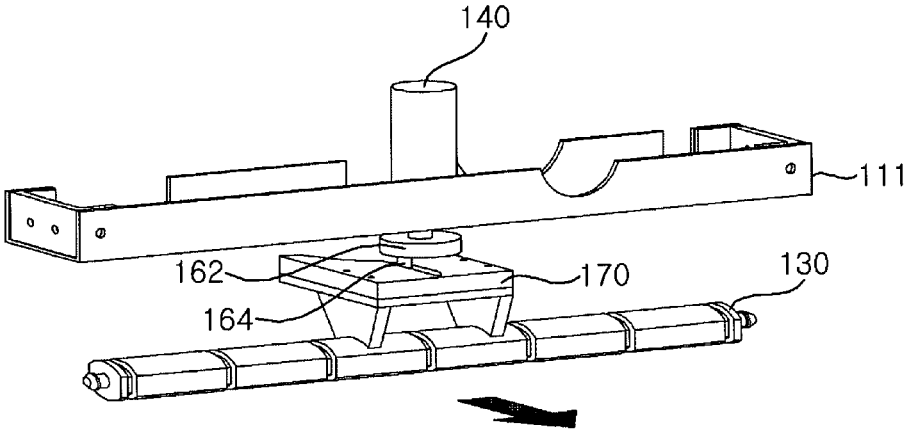
FIG. 3 illustrates a partial view of a fabric treatment apparatus according to another exemplary embodiment of the present invention.
Figure 4:
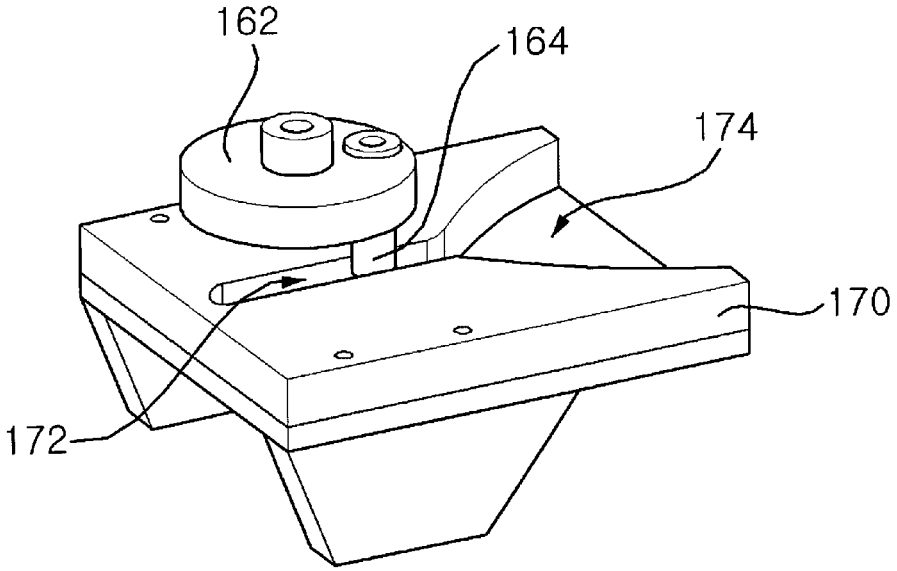
FIG. 4 illustrates a contact unit of the fabric treatment apparatus of the exemplary embodiment of FIG. 3.

FIG. 3 illustrates a partial perspective view of a fabric treatment apparatus according to another exemplary embodiment of the present invention, and FIG. 4 illustrates a contact unit of the fabric treatment apparatus of the exemplary embodiment of FIG. 3. Referring to FIGS. 3 and 4, a clothes rack 130 may be able to slide toward the direction in which the treatment room 110 is open, and the contact unit 170 may include a guide 174 which can be attached to or detached from an eccentric pin 164 and enables the eccentric pin 164 to be slid into a slot 172 of the contact unit 170.

When a door 20 is open, the clothes rack 130 may slide toward the direction in which the treatment room 110 is open.

The clothes rack 130 may be configured to move in various manners, other than that set forth herein. Connectors 150 may be rotatably coupled to a ceiling 111 of the treatment room 110, or the clothes rack 130 may be rotatably coupled to the connectors 150 and may thus be able to slide toward the direction in which the treatment room 110 is open.

When the clothes rack 130 slides out of the treatment room 110, the contact unit 170 may be detached from an eccentric unit 160 including the eccentric pin 164 and a circular plate 162. More specifically, when the clothes rack 130 slides out of the treatment room 110, the eccentric pin 164 may be disengaged from the slot 172 of the contact unit 170. On the other hand, when the clothes rack 130 slides back into the treatment room 110, the eccentric pin 164 may be inserted into the slot 172 and may thus be slidably coupled to the contact unit 170.

The contact unit 170 may include the guide 174, which guides the eccentric pin 164 of the eccentric unit 160 into the slot 172 of the contact unit 170 when the clothes rack 130 slides into the treatment room 110. The guide 174 may be implemented in various manners. In the exemplary embodiment of FIGS. 3 and 4, the guide 174 may be formed as a funnel and may extend from the slot 172 of the contact unit 170. Even when the eccentric pin 164 is disposed eccentrically with respect to the slot 172, the eccentric pin 164 may be guided into the slot 172 by the guide 174.

The operation of the fabric treatment apparatus of the exemplary embodiment of FIGS. 3 and 4 is almost the same as the operation of the fabric treatment apparatus of the exemplary embodiment of FIGS. 1 and 2 and thus will hereinafter be described in detail, focusing mainly on differences with the operation of the fabric treatment apparatus of the exemplary embodiment of FIGS. 1 and 2.

The user may open the door 20, and may slide the clothes rack 130 out of the treatment room 110. Thereafter, the user may hang up a number of hangers 30 where clothes are hung up on the clothes rack 130, and may slide the clothes rack 130 back into the treatment room 110. When the clothes rack 130 slides into the treatment room 110, the eccentric pin 164 may be guided into the slot 172 by the guide 174, which is funnel-shaped, and may thus be slide into the slot 172. Thereafter, the user may shut the door 20 and may operate the fabric treatment apparatus.

Figure 5:
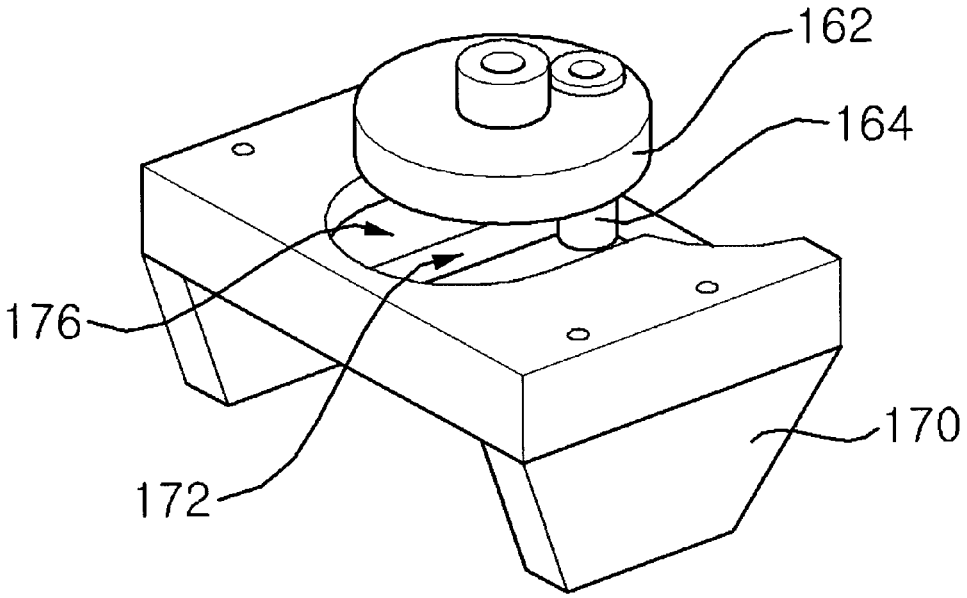
FIG. 5 illustrates a contact unit of a fabric treatment apparatus according to another exemplary embodiment of the present invention.
Figure 6:
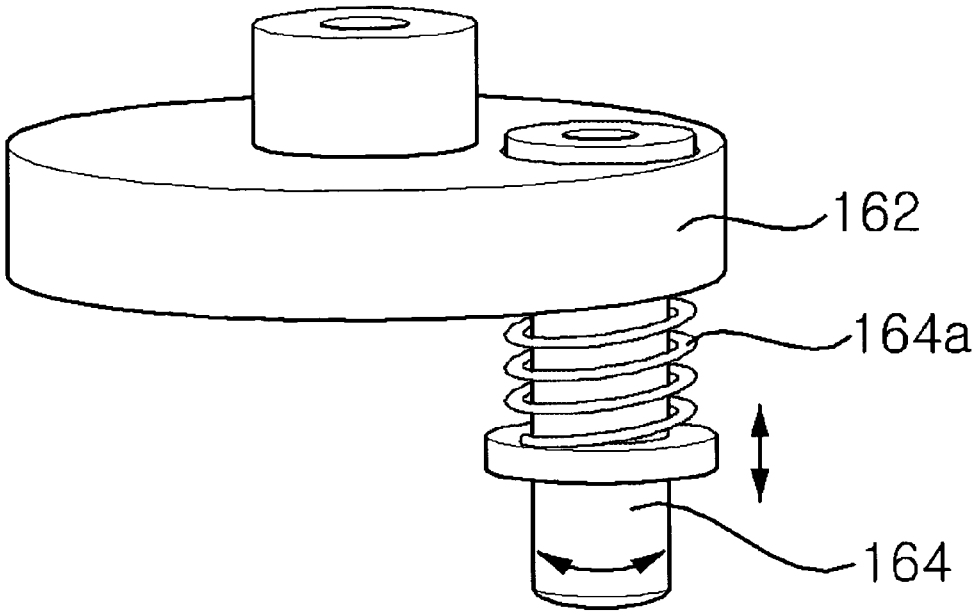

FIG. 5 illustrates a contact unit of a fabric treatment apparatus according to another exemplary embodiment of the present invention, and FIG. 6 illustrates an eccentric unit of the fabric treatment apparatus of the exemplary embodiment of FIG. 5. Referring to FIGS. 5 and 6, a clothes rack 130 may slide out toward the direction in which a treatment room 110 is open. A contact unit 170 can be attached to or detached from an eccentric pin 164, and may include a guide 176 which enables the eccentric pin 164 to be slid into a slot 172 of the contact unit 170.

The guide 176 may be formed as a slot. The guide 176 may be disposed above the slot 172 and may be wider than the slot 172. The eccentric pin 164 may include an elastic element 164*a* which is rotatably coupled to a circular plate 162.

When the eccentric unit 160 is detached from the contact unit 170 and then attached back to the contact unit 170, the eccentric pin 164 may be placed in contact with the guide 176 first if the eccentric pin 164 is disposed eccentrically with respect to the slot 172. In this case, the elastic element 164*a* of the eccentric pin 164 may contract. Then, when a motor 140 generates rotation force and thus the circular plate 162 rotates, the eccentric pin 164 may rotate inside the guide 176 and may then be slid into the slot 172 by the elastic force of the elastic element 164*a*.

According to the present invention, since a clothes rack on which a number of hangers are hung up moves reciprocally inside a fabric treatment apparatus in a linear path, it is possible to improve the efficiency of treating clothes on the hangers. In addition, since the clothes rack can slide out of the fabric treatment apparatus, it is easy to hang up hangers on the clothes rack.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fabric treatment apparatus comprising:

a treatment room which can receive and hold clothes;

a cabinet which forms the exterior of the treatment room;

a motor disposed in the cabinet and generating a rotational force;

an eccentric unit which is rotated eccentrically by the rotational force generated by the motor;

a contact unit which is coupled to the eccentric unit so as to be attachable or detachable from the eccentric unit;

a clothes rack which is disposed in the treatment room and is coupled to the contact unit so as to move reciprocally in a linear path, and on which a number of hangers can be hung;

a plurality of connectors provided at the ceiling of the treatment room to connect the clothes rack to the ceiling of the treatment room; and a heating unit which supplies at least one of hot air and steam into the treatment room, wherein the ceiling of the treatment room is spaced from the ceiling of the cabinet, wherein the motor includes, a main body disposed between the ceiling of the treatment room and the ceiling of the cabinet, and a rotation axial member penetrating the ceiling of the treatment room and coupled to the eccentric unit in the treatment room, wherein the contact unit includes a slot into which the eccentric unit is slidably coupled, wherein the eccentric unit includes a circular plate which is rotated by the rotational force generated by the motor and an eccentric pin which is disposed eccentrically with respect to the circular plate and is slidably coupled into the slot of the contact unit, wherein the plurality of connectors are formed of an elastic material so as to help the clothes rack reciprocally move in a linear path, and wherein when the clothes rack slides out toward a direction in which the treatment room opens, the eccentric pin slides out from the slot, wherein the direction is orthogonal to the linear path in which the clothes rack moves.

2. The fabric treatment apparatus of claim 1, wherein the contact unit includes a guide which guides the eccentric unit to be slidably coupled into the slot of the contact unit.

3. The fabric treatment apparatus of claim 2, wherein the guide is a bar-shaped protrusion.

4. The fabric treatment apparatus of claim 2, wherein the guide includes a funnel.

5. The fabric treatment apparatus of claim 4, wherein the guide is wider than the slot.

6. The fabric treatment apparatus of claim 2, wherein the guide is disposed above the slot.

7. The fabric treatment apparatus of claim 1, wherein the eccentric pin is rotatably coupled to the circular plate.

8. The fabric treatment apparatus of claim 1, wherein the eccentric pin includes an elastic element.

* * * * *